US008850822B2

(12) United States Patent
Parsania et al.

(10) Patent No.: US 8,850,822 B2
(45) Date of Patent: Oct. 7, 2014

(54) SYSTEM FOR PRE-MIXING IN A FUEL NOZZLE

(75) Inventors: Nishant Govindbhai Parsania, Bangalore (IN); Ajay Pratap Singh, Bangalore (IN)

(73) Assignee: General Electric Company, Schenectady, NY (US)

( * ) Notice: Subject to any disclaimer, the term of this patent is extended or adjusted under 35 U.S.C. 154(b) by 919 days.

(21) Appl. No.: 13/012,746

(22) Filed: Jan. 24, 2011

(65) Prior Publication Data

US 2012/0186255 A1 Jul. 26, 2012

(51) Int. Cl.

| | |
|---|---|
| ***F02C 1/00*** | (2006.01) |
| ***F23R 3/36*** | (2006.01) |
| *F23R 3/14* | (2006.01) |
| *F23R 3/28* | (2006.01) |

(52) U.S. Cl.

CPC ..... *F23R 3/36* (2013.01); *F23C 2900/07001* (2013.01); *F23R 3/14* (2013.01); *F23R 3/286* (2013.01)

USPC ..... 60/742; 60/737; 60/748

(58) Field of Classification Search

USPC ..... 60/737, 734, 742, 748

See application file for complete search history.

(56) References Cited

U.S. PATENT DOCUMENTS

| | | | | |
|---|---|---|---|---|
| 5,251,447 | A * | 10/1993 | Joshi et al. | 60/737 |
| 5,351,477 | A * | 10/1994 | Joshi et al. | 60/39.463 |
| 5,487,659 | A | 1/1996 | Eroglu et al. | |
| 5,778,676 | A * | 7/1998 | Joshi et al. | 60/746 |
| 6,132,202 | A | 10/2000 | Eroglu et al. | |
| 6,722,132 | B2 | 4/2004 | Stuttaford et al. | |
| 7,673,455 | B2 | 3/2010 | Yoshida et al. | |
| 2008/0078183 | A1 | 4/2008 | Ziminsky et al. | |
| 2010/0011770 | A1 * | 1/2010 | Chila et al. | 60/737 |
| 2010/0269508 | A1 * | 10/2010 | Saito et al. | 60/748 |

* cited by examiner

*Primary Examiner* — Gerald L Sung
*Assistant Examiner* — Scott Walthour
(74) *Attorney, Agent, or Firm* — Fletcher Yoder, P.C.

(57) ABSTRACT

A system includes a fuel nozzle. The fuel nozzle includes a hub having an axis, a shroud disposed about the hub, an airflow path between the hub and the shroud, multiple vanes extending between the hub and the shroud, and a first fuel path leading to multiple first fuel outlets disposed on the multiple vanes. The fuel nozzle also includes a second fuel path leading to multiple second fuel outlets disposed on at least one of the hub and/or the shroud, wherein the multiple second fuel outlets are disposed at an axial distance upstream from a downstream end of the hub.

19 Claims, 5 Drawing Sheets

SYSTEM FOR PRE-MIXING IN A FUEL NOZZLE

BACKGROUND OF THE INVENTION

The subject matter disclosed herein relates to a fuel nozzle with an improved fuel injection design.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., an electrical generator. The gas turbine engine includes a fuel nozzle to inject fuel and air into a combustor. As appreciated, the fuel air mixture significantly affects engine performance, fuel consumption, and emissions. In particular, inadequate atomization or vaporization of liquid fuel, non-uniform mixing of liquid or gas fuel, or both, may increase emissions, e.g., nitrogen oxides (NOx). Inadequate atomization may produce unburned fuel and may decrease power output or, alternatively, increase fuel consumption to maintain the same power output.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a multi-fuel nozzle. The multi-fuel nozzle includes a hub having an axis, a shroud disposed about the hub, an airflow path between the hub and the shroud, multiple vanes extending between the hub and the shroud, and multiple gas fuel outlets disposed on the multiple vanes. The multi-fuel nozzle also includes multiple liquid fuel outlets disposed on at least one of the hub and/or the shroud, wherein the multiple liquid fuel outlets are oriented in a radial direction relative to the axis.

In accordance with a second embodiment, a system includes a fuel nozzle. The fuel nozzle includes a hub having an axis, a shroud disposed about the hub, an airflow path between the hub and the shroud, multiple vanes extending between the hub and the shroud, and a first fuel path leading to multiple first fuel outlets disposed on the multiple vanes. The fuel nozzle also includes a second fuel path leading to multiple second fuel outlets disposed on at least one of the hub and/or the shroud, wherein the multiple second fuel outlets are disposed at an axial distance upstream from a downstream end of the hub.

In accordance with a third embodiment, a system includes a multi-fuel nozzle. The multi-fuel nozzle includes a hub having an axis, a shroud disposed about the hub, an airflow path between the hub and the shroud, multiple vanes extending between the hub and the shroud, and a first fuel path leading to multiple first fuel outlets disposed on the multiple vanes. The multi-fuel nozzle also includes a second fuel path leading to multiple second fuel outlets disposed on at least one of the hub and/or the shroud, wherein the first and the second fuel paths are configured to flow first and second fuels that are different from one another, the multiple second fuel outlets are disposed at an axial distance relative to a trailing edge of at least one vane of the multiple vanes, the axial distance is approximately 0 to approximately 50 percent of an axial length of the at least one vane, and the axial distance is upstream or downstream from the trailing edge.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
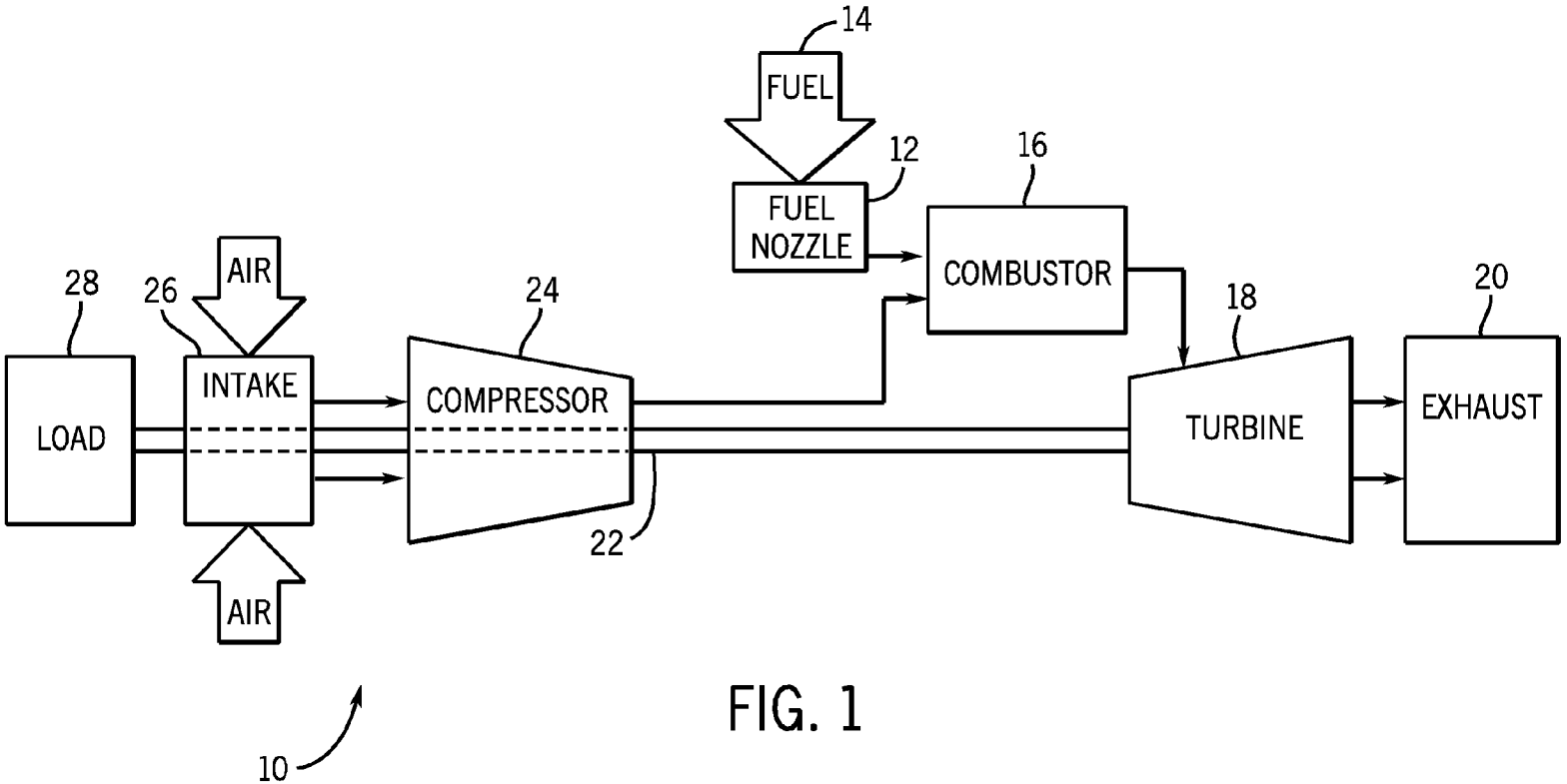
FIG. 1 is a block diagram of an embodiment of a turbine system having a fuel nozzle with an improved fuel injection design.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems for improving the injection of fuel (liquid and/or gas) into a fuel nozzle, thereby enhancing the atomization, evaporation, and premixing of the fuel (e.g., premixing fuel and air). In particular, embodiments of the present disclosure include a distributed fuel injection circuit that allows injection of liquid and/or gas fuel via fuel outlets disposed on the hub and/or shroud downstream from gas fuel outlets located on vanes extending between the hub and shroud, and upstream from a downstream end of the hub. In certain embodiments, a multi-fuel nozzle includes multiple liquid fuel outlets disposed on the hub or shroud. The liquid fuel outlets are oriented in a radial direction relative to an axis of the hub. The multiple liquid fuel outlets may be disposed on both the hub and shroud. Injection axes of the liquid fuel outlets may be angled approximately 45 to approximately 90 degrees relative to the axis to create cross-flow injection of the liquid fuel. In addition, the liquid fuel outlets may be distributed circumferentially between the vanes. Also, liquid fuel outlets disposed on both the hub and shroud may be located at similar axial positions or different axial positions. In further embodiments, the multi-fuel nozzle includes a first fuel path leading to multiple first fuel outlets disposed on the vanes as well as a second fuel path leading to multiple second fuel outlets disposed on the hub or the shroud. The multiple second fuel outlets disposed on the hub and/or shroud are disposed at an axial distance upstream from the downstream end of the hub. In yet further embodiments, the first and second fuel paths are configured to flow fuels that are different from each other (e.g., gas vs. liquid). The second fuel outlets are disposed at an axial distance relative to a trailing edge of at least one of the vanes. The axial distance is approximately 0 to approximately 50 percent of an axial length of the at least one vane, where the axial distance is either upstream or downstream from the trailing edge. By utilizing the distributed fuel injection circuit, liquid fuel may be injected via the hub and/or shroud to enhance the atomization, evaporation, and premixing of the liquid fuel, while reducing emissions. Therefore, the disclosed embodiments may eliminate any need for water to reduce emissions or atomizing air to break up the liquid fuel. In addition, use of gas fuel in the distributed fuel injection circuit may increase the premixing of the gas fuel with air as well as reduce emissions.

Turning now to the drawings and referring first to FIG. 1, a block diagram of an embodiment of a turbine system 10 is illustrated. As described in detail below, the disclosed turbine system 10 (e.g., a gas turbine engine) may employ one or more fuel nozzles 12 with an improved design for fuel injection to enhance atomization, evaporation, and premixing of one or more fuels (e.g., multi-fuel), while reducing emissions (e.g., NOx) in the turbine system 10. For example, each fuel nozzle 12 may include a distributed fuel injection circuit configured to improve atomization, evaporation, and premixing of fuel with air in the fuel nozzle 12. The turbine system 10 may use liquid and/or gas fuel, such as natural gas and/or a hydrogen rich synthetic gas, to drive the turbine system 10. As depicted, one or more fuel nozzles 12 (e.g., multi-fuel nozzles) intake a fuel supply 14 (e.g., liquid and/or gas fuel), mix the fuel with air, and distribute the air-fuel mixture into a combustor 16 in a suitable ratio for optimal combustion, emissions, fuel consumption, and power output. The turbine system 10 may include one or more fuel nozzles 12 located inside one or more combustors 16. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of the turbine system 10.

Figure 2:
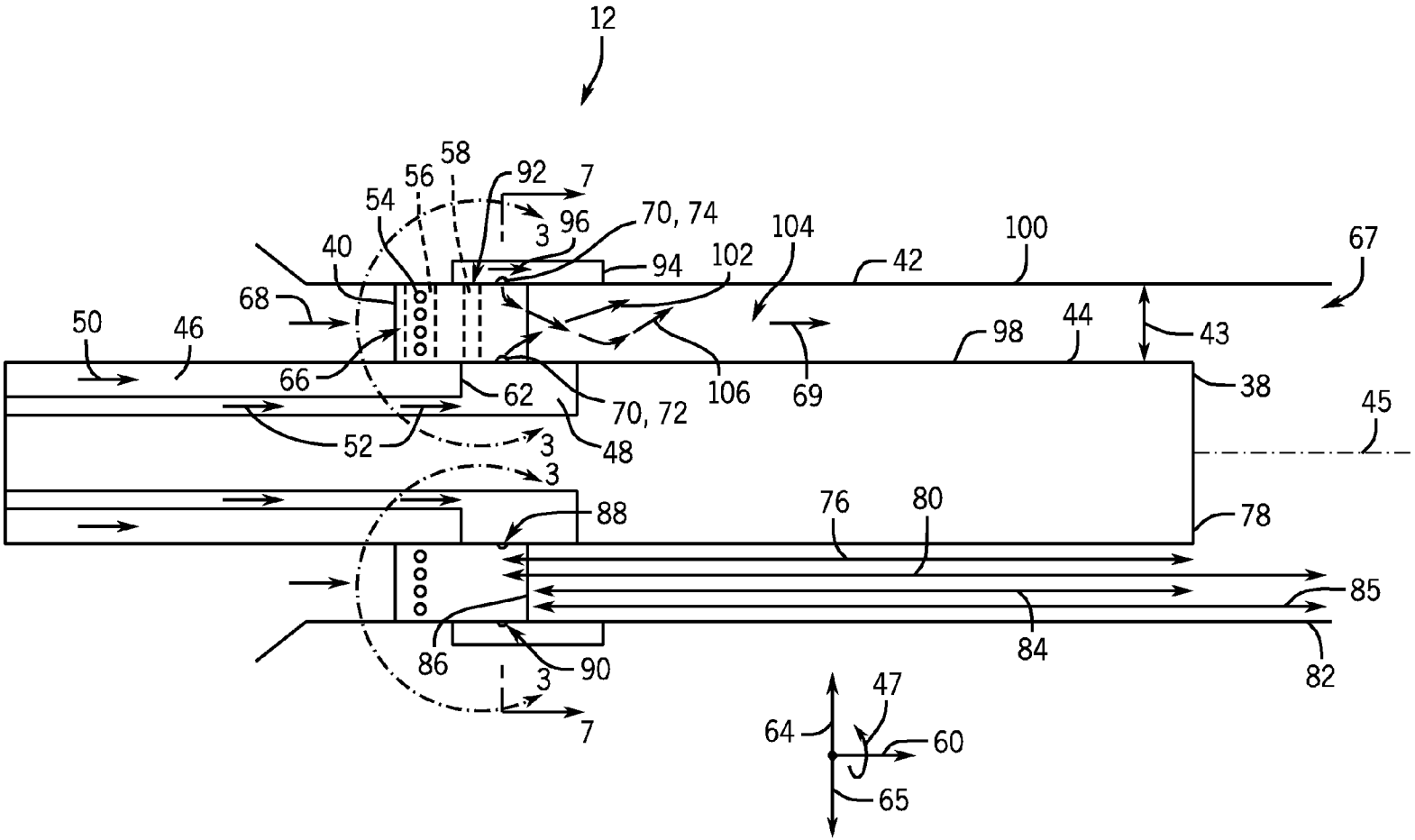
FIG. 2 is a cross-sectional side view of an embodiment of the fuel nozzle, as illustrated in FIG. 1, with the fuel nozzle having an improved fuel injection design.

FIG. 2 is a cross-sectional side view of an embodiment of the fuel nozzle 12 of FIG. 1, illustrating an improved fuel injection design to enhance atomization, evaporation, and premixing of fuel, while also reducing emissions. The fuel nozzle 12 includes a center body 38 (e.g., annular inner body), a plurality of vanes 40 (e.g., swirl vanes), and a shroud 42 (e.g., annular outer body), each disposed about an axis 45. The center body 38 includes a hub 44 (e.g., an annular wall) disposed inside and concentric with the shroud 42, wherein the shroud 42 and the hub 44 are offset from one another by a radial gap 43. The vanes 40 extend radially 64 between the shroud 42 and the hub 44, and are distributed circumferentially 47 about the axis 45. The shroud 42 is circumferentially 47 disposed about the hub 44 and the plurality of vanes 40 with the vanes 40 extending between the hub 44 and shroud 42. The fuel nozzle 12 may include any number of vanes 40 as described in greater detail below. The center body 38 also includes fuel passages 46 and 48 (e.g., annular fuel passages). In certain embodiments, the center body 38 includes air passages that alternate with fuel passages 48 circumferentially 47 about the center body 38.

The fuel nozzle 12 includes multiple fuel paths, generally indicated by arrows 50 and 52. The fuel paths 50 and 52 may be configured to flow the same or different fuels independent from one another. For example, the first fuel path 50 may be configured to flow gas fuel, while the second fuel path 52 may be configured to flow liquid fuel (i.e., multi-fuel nozzle) or vice versa. However, the first and second fuel paths 50 and 52 may flow two different gas fuels, two different liquid fuels, or any combination of fuels. In certain embodiments, the fuel paths 50 and 52 may be configured to flow the same fuel (e.g., gas fuel). The first fuel path 50 extends through the fuel passage 46 and leads to a plurality of fuel outlets 54 (e.g., gas fuel outlets) disposed on the plurality of vanes 40. Each vane 40 includes one or more fuel outlets 54. The number of fuel outlets 54 on each vane 40 may range from 1 to 50, 1 to 10, 4 to 20, or 4 to 10, or any other number. For example, each vane 40 may include one or more fuel outlets 54 (e.g., 1 to 10) on each side. Each vane 40 also includes hollow compartments or passages 56 and 58. The plurality of vanes 40 is configured to swirl or rotate air, while mixing fuel with air. For example, fuel (e.g., gas fuel) flows in an axial direction 60 through the fuel passage 46 until it abuts wall 62 in the fuel passage 46. Upon abutting wall 62, the fuel flows in a radial direction 64 into a fuel compartment 56 of each vane 40 and exits the fuel compartment 56 via fuel outlets 54 into a mixing region 66. As illustrated, the fuel nozzle 12 includes an airflow path (e.g., annular airflow path), generally indicated by arrow 68, between the hub 44 and the shroud 42. Air flows in the axial direction 60 through the airflow path 68 into the mixing region 66 surrounding each vane 40. In the mixing region 66 of each vane 40, fuel from the fuel outlets 54 interacts with the air. The fuel-air mixture is swirled by the vanes 40 to aid in mixing of the fuel and air for proper combustion, and flows downstream towards an exit 67 of the fuel nozzle 12, as generally indicated by arrow 69.

The second fuel path 52 extends through fuel passage 48 and leads to a plurality of fuel outlets 70 (e.g., liquid fuel outlets) disposed, as illustrated, on the hub 44 (i.e., fuel outlet 72) and shroud 42 (i.e., fuel outlet 74). The fuel outlets 70 are oriented in the radial direction 64 relative to the axis 45 of the hub 44. In certain embodiments, the fuel outlets 70 may be disposed only on the hub 44, only on the shroud 42, or on both the hub 44 and the shroud 42. The illustrated fuel outlets 72 and 74 may each represent one or more fuel outlets 70 disposed circumferentially 47 about the hub 44 and shroud 42, respectively, between the plurality of vanes 40 (see FIG. 7).

As illustrated, the plurality of fuel outlets 70 is disposed downstream from the plurality of fuel outlets 54 (e.g., gas fuel outlets). In particular, the fuel outlets 70 are disposed at an axial distance 76 upstream from a downstream end 78 of the hub 44 and an axial distance 80 upstream from a downstream end 82 of the shroud 42. The axial distance 76 may range from approximately 50 to 150 percent, 75 to 125 percent, or 90 to 110 percent of a vane distance 84 between the downstream end 78 of the hub 44 and a trailing edge 86 of at least one vane 40 of the plurality of vanes 40. For example, the axial distance 76 may be approximately 50, 60, 70, 80, 90, 100, 110, 120, 130, 140, or 150 percent, or any other percent therebetween of the vane distance 84. The axial distance 80 may range from approximately 50 to 150 percent, 75 to 125 percent, or 90 to 110 percent of a vane distance 85 between the downstream end 82 of the shroud 42 and a trailing edge 86 of at least one vane 40 of the plurality of vanes 40. For example, the axial distance 80 may be approximately 50, 60, 70, 80, 90, 100, 110, 120, 130, 140, or 150 percent, or any other percent therebetween of the vane distance 85. The fuel outlets 70 (i.e., 72) are disposed on the hub 44 at an axial position generally indicated by arrow 88. The fuel outlets 70 (i.e., 74) are disposed on the shroud 42 at another axial position generally indicated by 90. As illustrated, the axial positions 88 and 90 are the same for the fuel outlets 72 and 74. In certain embodiments, the axial positions 88 and 90 for the fuel outlets 72 and 74 may be axially offset from one another (see FIG. 4).

Fuel (e.g., liquid fuel) flows in the axial direction 60 through the fuel passage 48. A portion of the fuel (e.g., approximately 50 percent or less of the liquid fuel) exits fuel outlets 72 disposed on the hub 44 crosswise to the axis 45 of the hub 44 and downstream of the mixing region 66 of fuel (e.g., gas fuel) and air. The other portion of the fuel (e.g., liquid fuel) flows in a radial direction 64 through the passage 58 (e.g., vane passage) in each vane 40 and exits via an outlet 92 into enclosure 94. The enclosure 94 is circumferentially 47 disposed about the shroud 42. Fuel flows, as generally indicated by arrow 96, in the axial direction 60 and exits the fuel outlets 74 disposed on the shroud 74 crosswise to the axis 45 of the hub 44 and downstream of the mixing region 66 of fuel (e.g., gas fuel) and air.

The arrangement of the fuel outlets 70 (i.e., 72 and 74), as described in greater detail below, allows the radial injection of fuel (e.g., liquid fuel) from fuel outlets 72 and 74. For example, the fuel outlets 72 and 74 are oriented crosswise to one another (e.g., in outward 64 and inward 65 radial directions, respectively) and to axis 45. The liquid momentum ratio of the fuel may be controlled to reduce the possibility of the jets of fuel from fuel outlets 72 and 74 from impacting walls 98 and 100 of the hub 44 and the shroud 42, respectively. Injected fuel from fuel outlets 72, as generally indicated by arrows 102, tends to flow with the swirl (i.e., from the wall 98 of hub 44 towards the wall 100 of the shroud 42) within a passage 104 between the hub 44 and shroud 42. Injected fuel from fuel outlets 74 located at a higher radius (i.e., at the shroud 42), as generally indicated by arrows 106, initially tends to flow opposite of the swirl toward the wall 98 of the hub 44, then flows towards the wall 100 of the shroud 42. The higher radius for the fuel outlets 74 provides more area for evaporation of the fuel. Also, the higher radius for the fuel outlets 74 prevents jet of fuel from outlets 74 from colliding with each other to enhance atomization. Overall, the higher radius of the fuel outlets 74 enhances atomization, evaporation, and premixing of the fuel.

In certain embodiments, fuel nozzle 12 may include one or more air outlets to enhance fuel/air mixing and to cool the nozzle 12. For example, air outlets or passages may direct cooling air along the fuel passages 48 or the vanes 40 to reduce the possibility of coking. In further embodiments, air outlets may be disposed on the shroud 42 and/or the hub 44 downstream of the fuel outlets 70 to enhance atomization as well as to reduce the possibility of flame holding within the passage 104 of the fuel nozzle 12.

Figure 3:
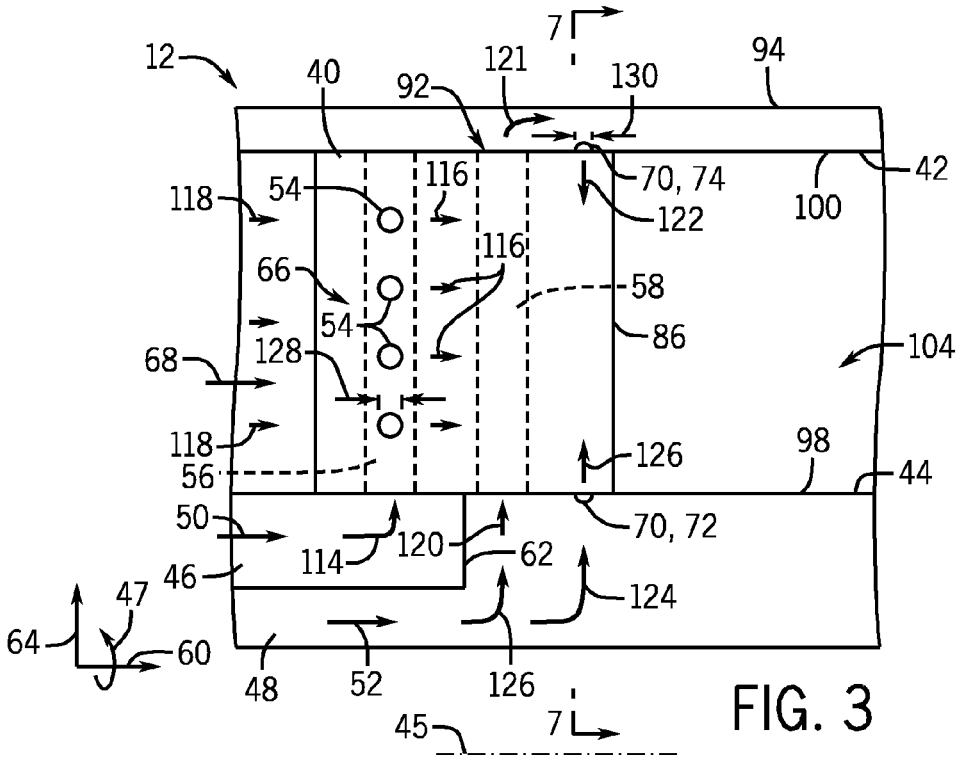
FIG. 3 is a partial cross-sectional side view of an embodiment of the fuel nozzle of FIG. 2 taken within line 3-3, illustrating fuel paths and fuel outlets in a region having a vane.

FIGS. 3-7 are partial cross-sectional side views of the fuel nozzle 12 of FIG. 2, illustrating embodiments of the fuel outlets 70. FIG. 3 is a cross-sectional side view of an embodiment of the fuel nozzle 12 of FIG. 3 taken within line 3-3, illustrating a region having one of the vanes 40, fuel paths 50 and 52, and fuel outlets 54 and 70. Fuel flow along fuel paths 50 and 52 to the outlets 54 and 70 as described above. For example, fuel (e.g., gas fuel) flows through fuel passage 46 (e.g., gas fuel passage) and turns, as indicated by arrow 114, into the fuel compartment 56 within the vane 40. Then, the fuel exits the fuel outlets 54 (e.g., gas fuel outlets), as indicated by arrows 116, and mixes with air 118 flowing in the airflow path 68 within the mixing region 66 of the passage 104. Also, as described above, fuel (e.g., gas or liquid fuel) flows through fuel passage 48 (e.g., gas or liquid fuel passage) where a portion of the fuel is diverted through passage 58 within the vane 40, as indicated by arrows 120, in the radial direction 64. The fuel exits via the outlet 92 into the enclosure 94, as indicated by arrow 121, and is injected crosswise into passage 104, as indicated by arrow 122, via fuel outlets 74 (e.g., gas or liquid fuel outlets) disposed on the shroud 42. Another portion of the fuel flows, as indicated by arrow 124, toward the fuel outlets 72 (e.g., gas or liquid fuel outlets) disposed on the hub 44 and is also injected crosswise into the passage 104, as indicated by arrow 126, via outlets 72.

Structurally, the fuel outlets 54 and 70 are as described above. The fuel outlets 54 (e.g., gas fuel outlets) have diameters 128 of at least approximately 100 mils. The fuel outlets 70 (e.g., gas or liquid fuel outlets) have diameters 130, which may range from approximately 15 to 100 mils, 20 to 80 mils, 20 to 60 mils, or 20 to 40 mils. For example, the diameters 130 may be approximately 20, 25, 30, 35, 40, 45, 50, 55, or 60 mils, or any other dimension therebetween. The diameters 130 of the fuel outlets 70 are large enough to reduce the possibility of clogging of fuel in the outlets 70. In certain embodiments, the diameter 128 of each fuel outlet 54 of the plurality of fuel outlets 54 may be the same as each fuel outlet 70 of the plurality of fuel outlets 70. In other embodiments, the diameter 130 of each fuel outlet 70 (e.g., liquid fuel outlet) of the plurality of fuel outlets 70 (e.g., liquid fuel outlets) is smaller than the diameter 128 of each fuel outlet 54 (e.g., gas fuel outlet) of the plurality of the fuel outlets 54 (e.g., gas fuel outlets). For example, the diameter 130 of each fuel outlet 70 may range from approximately 10 to 70 or 30 to 60 percent the diameter 128 of each fuel outlet 54. Altering the diameters 130 of the fuel outlets 70 may allow the liquid momentum ratio to be controlled.

Figure 4:
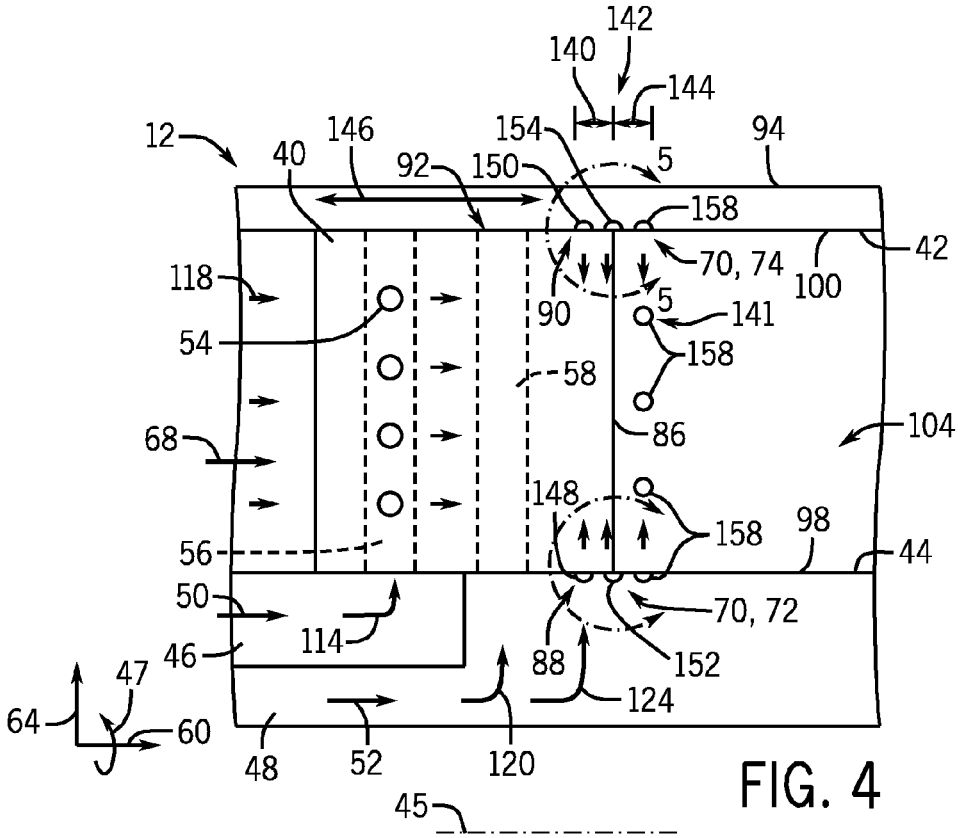
FIG. 4 is a partial cross-sectional side view of an embodiment of the fuel nozzle of FIG. 2 taken with line 3-3, illustrating fuel paths and fuel outlets in a region having a vane.

FIG. 4 is a partial cross-sectional side view of an embodiment of the fuel nozzle 12 of FIG. 2 taken within line 3-3, illustrating a region having one of the vanes 40, fuel paths 50 and 52, and fuel outlets 54 and 70. The illustrated fuel outlets 72 (i.e., 148, 152, 156) and fuel outlets 74 (i.e., 150, 154, 158) may each represent sets of fuel outlets 70 disposed circumferentially 47 about the hub 44 and shroud 42, respectively, between the plurality of vanes 40 (see FIG. 7). For example, a set 141 of fuel outlets 158 is circumferentially 47 disposed about the shroud 42. Each set of fuel outlets 70 may include 1 to 50, 1 to 10, or 1 to 5 fuel outlets. For example, each set of fuel outlets 70 may include at least 1, 2, 3, 4, 5, 6, 7, 8, 9, or 10, or any other number of fuel outlets 70.

As illustrated, the plurality of fuel outlets 70 may be axially positioned upstream, downstream, or both upstream and downstream of the trailing edges 86 of the vanes 40. The fuel outlets 72 (e.g., liquid fuel outlets) are disposed on the hub 44 at an axial region 88 (e.g., three axial positions) along the axis 45, while the fuel outlets 74 (e.g., liquid fuel outlets) are disposed on the shroud 42 at axial region 90 (e.g., three axial positions) along the axis 45. In certain embodiments, the axial regions 88 and 90 (e.g., three axial positions) of the fuel outlets 72 and 74 may be the same (e.g., fuel outlets 152 and 154). In other embodiments, the axial regions 88 and 90 (e.g., three axial positions) of the fuel outlets 72 and 74 may be offset from one another. For example, the fuel outlets 148 and 150 may be axially offset, fuel outlets 152 and 154 may be axially offset, and/or fuel outlets 156 and 158 may be axially offset. As illustrated, the axial regions 88 and 90 overlap the downstream end or trailing edge 86 of the vane 90, e.g., fuel outlets 148 and 150 are upstream from trailing edge 86, fuel outlets 152 and 154 are at trailing edge 86, and fuel outlets 156 and 158 are downstream from trailing edge 86.

In particular, the upstream fuel outlets 148 and 150 are disposed at an axial distance 140 relative to the trailing edge 86 of at least one vane 40. The fuel outlets 152 and 154 are disposed at an axial distance 142 of approximately zero relative to the trailing edge 86 of at least one vane 40. The downstream fuel outlets 156 and 158 are disposed at an axial distance 144 relative to the trailing edge 86 of the at least one vane 40. Furthermore, all of the fuel outlets 148, 150, 152, 154, 156, and 158 are downstream from the fuel outlets 54 and upstream from the ends 78 and 82 of the hub 44 and shroud 42. For example, the axial distances 140 and 144 may be approximately 0 to 70 percent, 0 to 50 percent, 0 to 30 percent, or 0 to 15 percent of an axial length 146 of the at least one vane 40. By further example, the axial distances 140 and 144 may be approximately 5, 10, 15, 20, 25, 30, 35, 40, 45, or 50 percent, or any percent therebetween of the axial length 146, wherein the distance 140 is upstream and the distance 144 is downstream from the trailing edge 86. In some embodiments, the fuel outlets 70 or 72 may include only the upstream fuel outlets 148 and 150, only the fuel outlets 152 and 154 at the trailing edge 86, or only the downstream fuel outlets 156 and 158. However, embodiments of the fuel nozzle 12 may include any combination of upstream, downstream, or edge aligned fuel outlets relative to the trailing edge 86.

Figure 5:
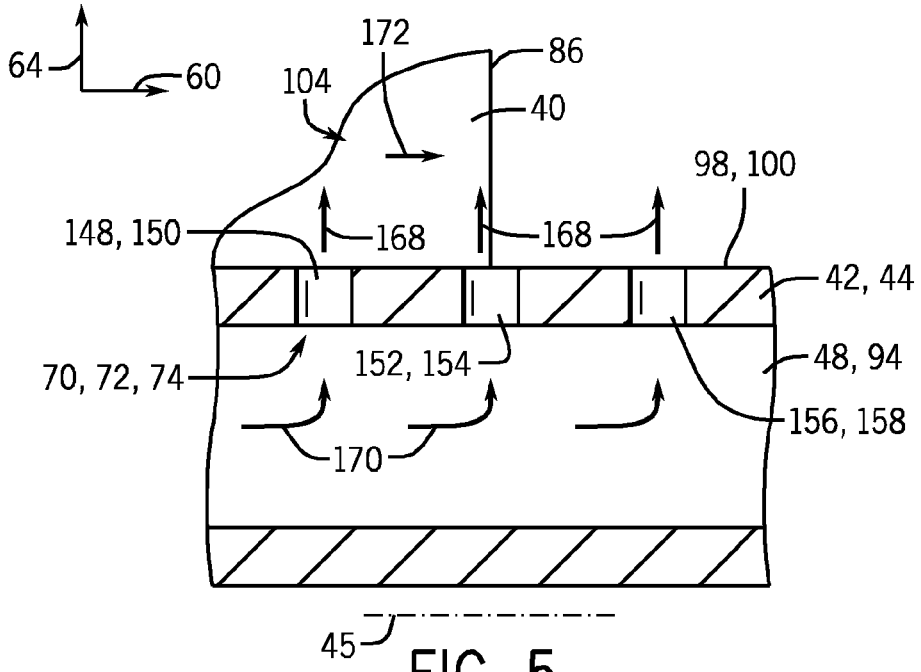
FIG. 5 is a partial cross-sectional side view of an embodiment of the fuel nozzle of FIG. 4 taken within line 5-5, illustrating radial fuel outlets adjacent the vane.
Figure 6:
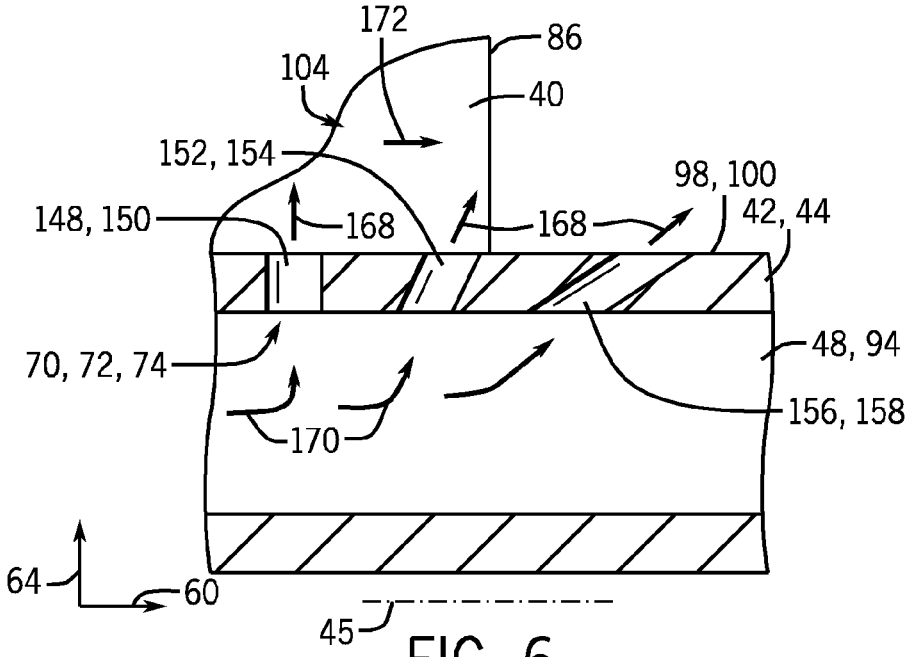
FIG. 6 is a partial cross-sectional side view of an embodiment of the fuel nozzle of FIG. 4 taken within line 5-5, illustrating radial fuel outlets adjacent the vane.

FIGS. 5 and 6 are partial cross-sectional side views of embodiments of the fuel nozzle 12 of FIG. 4 taken within line 5-5, illustrating radial fuel outlets 148, 150, 152, 154, 156, and 158 adjacent the vane 40. The fuel outlets 148, 152, and 156 represent fuel outlets 70, 72 disposed on the hub 44, while the fuel outlets 150, 154, and 158 represent fuel outlets 70, 74 on the shroud 42. As previously described, fuel (e.g., gas or liquid fuel), generally indicated by arrows 170, flows in the axial direction 60 within fuel passage 48 or enclosure 94 prior to exiting the fuel outlets 70. The fuel outlets 70 are oriented in the radial direction 64 relative to the axis 45. The fuel outlets 70 may have straight or compounded angles. The fuel outlets 70 may have injection axes 168 angled between approximately 45 to 90 degrees, 45 to 75, or 45 to 60 degrees relative to the axis 45. For example, the fuel outlets 70 may have injection axes 168 angled at approximately 45, 50, 55, 60, 65, 70, 75, 80, 85, or 90 degrees, or any degrees therebetween relative to the axis 45. In certain embodiments, the injection axes 168 may be angled at less than approximately 90 degrees relative to the axis 45. As illustrated in FIG. 5, all of the injection axes 168 of the fuel outlets 70 are approximately 90 degrees relative to the axis 45. As a result, the fuel flows along injection axes 168 are perpendicular to the air flow 172 through the passage 104. As illustrated in FIG. 6, the angles of the injection axes 168 decrease in the axial direction 60 relative to the axis 45. Fuel outlets 148 and 150, 152 and 154, and 156 and 158 provide examples of injection axes 168 with angles of 90 degrees, 60 degrees, and 45 degrees, respectively, relative to the axis 45. As a result, fuel flows along these injection axes 168 are generally crosswise to the air flow 172 through the passage 104. In certain embodiments, angles of the injection axes 168 may vary within sets and/or between sets of fuel outlets 70. For example, the angle of injection axes 168 may progressively change (e.g., increase or decrease) from fuel outlets 148, 150 to fuel outlets 152, 154 and from fuel outlets 152, 154 to fuel outlets 156, 158. The amount of change in angle from one axial position to another of the fuel outlets 70 may be approximately 5 to 90, 5 to 60, 5 to 45 or 10 to 30 degrees.

Figure 7:
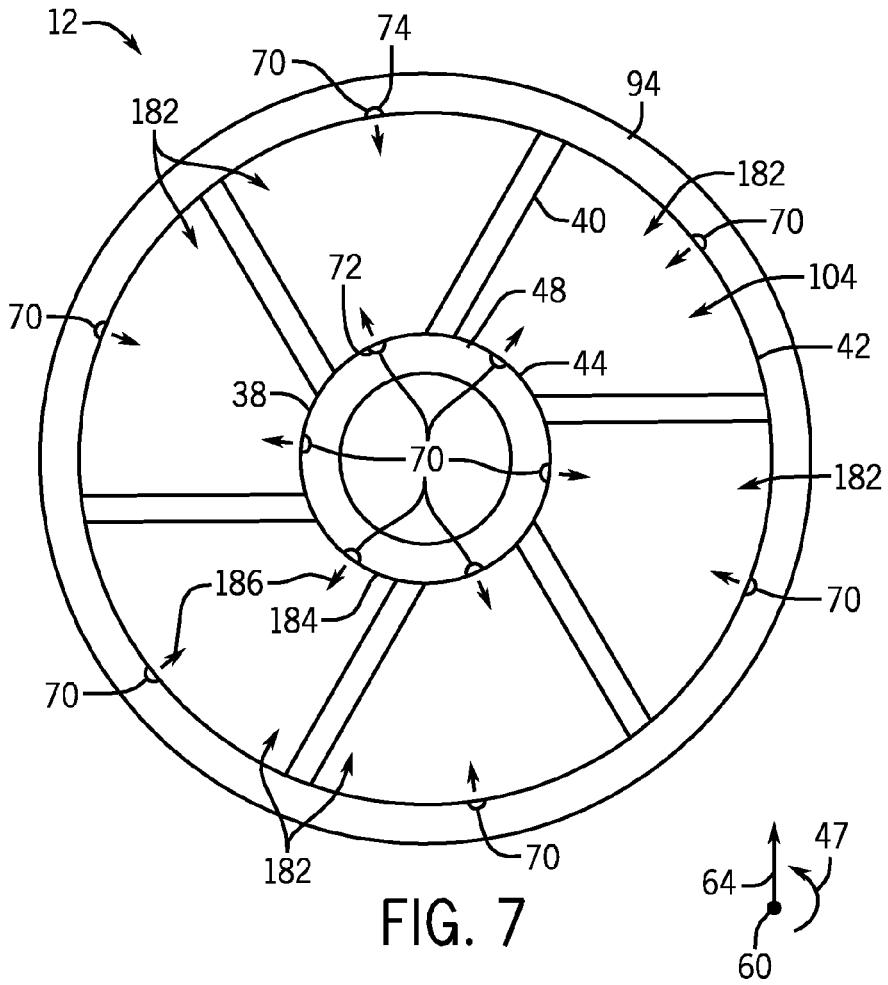
FIG. 7 is a cross-sectional view of an embodiment of the fuel nozzle, taken along line 7-7 of FIGS. 2 and 3, illustrating radial fuel outlets circumferentially spaced between vanes.

FIG. 7 is a cross-sectional view of an embodiment of the fuel nozzle 12, taken along line 7-7 of FIGS. 2 and 3. As previously described, the fuel nozzle 12 (e.g., multi-fuel nozzle) includes the center body 38, the hub 44, the shroud 42, and the plurality of vanes 40 extending radially between the hub 44 and the shroud 42. The center body 38 includes the fuel passage 48 (e.g., annular fuel passage). The fuel nozzle 12 also includes the enclosure 94 circumferentially 47 disposed about the shroud 42. Further, the fuel nozzle 12 includes fuel outlets 70 (i.e., 72 and 74), e.g., gas or liquid fuel outlets, distributed circumferentially 47 between the plurality of vanes 40. The fuel outlets 70 may be distributed between and within confines of the vanes 40 as illustrated. Alternatively, the fuel outlets 70 may be distributed circumferentially 47 between the vanes 40, but downstream in the axial direction 60 away from the vanes 40.

Each fuel nozzle 12 may include any number of vanes 40. For example, each fuel nozzle 12 may include 1 to 20 or 2 to 10 vanes 40, or any number therebetween. Circumferentially 47 about each fuel nozzle 12, the vanes 40 divide the passage 104 into multiple sectors 182 for the injection of liquid or gas fuel via fuel outlets 70 into the passage 104. For example, 10 vanes 40 evenly disposed about a circumference 184 of the fuel nozzle 12 may result in 10 sectors 182 of about 36 degrees each. As illustrated, 6 vanes 40 evenly disposed about the circumference 184 of the fuel nozzle 12 results in 6 sectors 182 of about 60 degrees each. As illustrated, the fuel nozzle 12 includes a first plurality of fuel outlets 72 (e.g., liquid fuel outlets) distributed circumferentially 47 between the plurality of vanes 40 on the hub 44, and a second plurality of fuel outlets 74 distributed circumferentially 47 between the plurality of vanes 40 on the shroud 42. As illustrated, each sector 182 between a pair of vanes 40 includes at least one fuel outlet 72 disposed on the hub 44 and at least one fuel outlet 74 disposed on the shroud 42. However, each illustrated fuel outlet 70 may represent a plurality of fuel outlets 70 at different axial positions relative to axis 60, or a plurality of fuel outlets 70 at different circumferential positions 47. The fuel outlets 70, as illustrated, are centrally spaced between the vanes 40 on both the hub 44 and the shroud 42. In other words, the fuel outlets 70, 72 are centered circumferentially 47 between the adjacent vanes 40 on the hub 44, while the fuel outlets 70, 74 are centered circumferentially 47 between the adjacent vanes 40 on the shroud 42. Alternatively, the fuel outlets 70 may not be centrally spaced between the vanes 40. Each fuel outlet 70 injects fuel (e.g., liquid or gas fuel), as indicated by arrows 186, into the passage 104 in the radial direction 64 generally crosswise to the flow to enhance atomization, evaporation, and premixing as well as to reduce emissions (e.g., NOx).

In certain embodiments, fuel outlets 70 may not be distributed within each sector 182 between the vanes 40. For example, the sectors 182 may alternate between the outlets 70 and air outlets along the hub 44 and/or the shroud 42. In other words, the fuel nozzle 12 may alternate between air injection and fuel injection in each sector 182, or each sector 182 may alternate between hub 44 fuel injection/shroud 42 air injection and hub 44 air injection/shroud 42 fuel injection. Also, in certain embodiments, the fuel nozzle 12 may include air outlets disposed on the shroud 42 and/or the hub 44 downstream of the fuel outlets 70 in the axial direction 60 to enhance atomization and to reduce the possibility of flame holding within the fuel nozzle 12.

Technical effects of the disclosed embodiments include providing systems for improving the injection of fuel (liquid or gas) into the fuel nozzle 12. Fuel outlets 70 located downstream of gas fuel injection from the vanes 40 allow for hub 44 and/or shroud 42 injection of fuel (e.g., liquid or gas fuel) crosswise to the airflow. The fuel may be distributed between these fuel outlets 70 for cross-flow injection at a variety of angles (e.g., 0 to 90 degrees). The improved design enhances atomization, evaporation, and premixing. In addition, the design reduces emissions. The improved design eliminates the need for atomizing air and water and, thus, reduces costs associated therewith.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-fuel nozzle, comprising:

a center body comprising a hub having an axis;

a shroud disposed about the hub;

an enclosure circumferentially disposed about a portion of the shroud;

an airflow path between the hub and the shroud;

a plurality of vanes extending between the hub and the shroud, wherein at least one vane of the plurality of vanes has an internal passage extending between the center body and the enclosure;

a plurality of gas fuel outlets disposed on the plurality of vanes;

a first plurality of liquid fuel outlets disposed on the hub and a second plurality of liquid fuel outlets disposed on the shroud, wherein the first and second pluralities of liquid fuel outlets are oriented in a radial direction relative to the axis; and a liquid fuel passage extending through a portion of the center body to the first plurality of liquid fuel outlets disposed on the hub and extending from the center body to the enclosure via the internal passage of the at least one vane to the second plurality of liquid fuel outlets disposed on the shroud.

2. The system of claim 1, wherein the first plurality of liquid fuel outlets or the second plurality of liquid fuel outlets is disposed at an axial distance upstream from a first downstream end of the hub and a second downstream end of the shroud.

3. The system of claim 2, wherein the axial distance is approximately 75 percent to approximately 125 percent of a vane distance between the first downstream end of the hub and a trailing edge of the at least one vane of the plurality of vanes.

4. The system of claim 1, wherein both the first and second pluralities of liquid fuel outlets are disposed at an axial distance relative to a trailing edge of the at least one vane of the plurality of vanes, wherein the axial distance is approximately 0 to approximately 50 percent of an axial length of the at least one vane, and the axial distance is upstream or downstream from the trailing edge.

5. The system of claim 1, wherein the first plurality of liquid fuel outlets or the second plurality of liquid fuel outlets has fuel injection axes angled less than approximately 90 degrees relative to the axis.

6. The system of claim 5, wherein the first plurality of liquid fuel outlets or the second plurality of liquid fuel outlets has fuel injection axes angled between approximately 45 to approximately 90 degrees relative to the axis.

7. The system of claim 1, wherein the first plurality of liquid fuel outlets or the second plurality of liquid fuel outlets is distributed circumferentially between the plurality of vanes.

8. The system of claim 7, wherein the first plurality of liquid fuel outlets is distributed circumferentially between the plurality of vanes on the hub, and the second plurality of liquid fuel outlets is distributed circumferentially between the plurality of vanes on the shroud.

9. The system of claim 1, wherein the first plurality of liquid fuel outlets are disposed on the hub at a first axial position along the axis and the second plurality of liquid fuel outlets are disposed on the shroud at a second axial position along the axis, and the first and second axial positions are axially offset from one another.

10. The system of claim 1, wherein both the first and second pluralities of liquid fuel outlets are disposed downstream from the plurality of gas fuel outlets.

11. The system of claim 1, the system comprising a turbine combustor or a gas turbine engine having the multi-fuel nozzle.

12. The system of claim 1, wherein the first plurality of liquid fuel outlets comprise a first set of liquid fuel outlets disposed on the hub at a first axial position along the axis upstream from both a downstream end of the hub and a trailing edge of at least one vane of the plurality of vanes, a second set of liquid fuel outlets disposed on the hub at a second axial position along the axis upstream from the downstream end of the hub and at the trailing edge of at least one vane of the plurality of vanes, and a third set of liquid fuel outlets disposed on the hub at a third axial position along the axis upstream from the downstream end of the hub and downstream of the trailing edge of at least one vane of the plurality of vanes.

13. The system of claim 1, wherein the second plurality of liquid fuel outlets comprise a first set of liquid fuel outlets disposed on the shroud at a first axial position along the axis upstream from both a downstream end of the hub and a trailing edge of at least one vane of the plurality of vanes, a second set of liquid fuel outlets disposed on the shroud at a second axial position along the axis upstream from the downstream end of the hub and at the trailing edge of at least one vane of the plurality of vanes, and a third set of liquid fuel outlets disposed on the shroud at a third axial position along the axis upstream from the downstream end of the hub and downstream of the trailing edge of at least one vane of the plurality of vanes.

14. The system of claim 1, wherein each vane of the plurality of vanes has a respective internal passage extending between the center body and the enclosure, and the respective internal passages of the plurality of vanes alternate between the liquid fuel passage and an air passage circumferentially about the center body.

15. A system, comprising:

a fuel nozzle, comprising:

a center body comprising a hub having an axis;

a shroud disposed about the hub;

an enclosure circumferentially disposed about a portion of the shroud;

an airflow path between the hub and the shroud;

a plurality of vanes extending between the hub and the shroud, wherein at least one vane of the plurality of vanes has an internal passage extending between the center body and the enclosure;

a first fuel path leading to a plurality of first fuel outlets disposed on the plurality of vanes; and a second fuel path leading to a first plurality of second fuel outlets disposed on the hub and a second plurality of second fuel outlets disposed on the shroud, wherein the first and second pluralities of second fuel outlets are disposed at an axial distance upstream from a downstream end of the hub, and wherein the second fuel path extends through a portion of the center body to the first plurality of second fuel outlets disposed on the hub and extends from the center body to the enclosure via the internal passage of the at least one vane to the second plurality of second fuel outlets disposed on the shroud.

16. The system of claim 15, the system comprising a turbine combustor or a gas turbine engine having the fuel nozzle.

17. A system, comprising:

a multi-fuel nozzle, comprising:

a center body comprising a hub having an axis;

a shroud disposed about the hub;

an enclosure circumferentially disposed about a portion of the shroud;

an airflow path between the hub and the shroud;

a plurality of vanes extending between the hub and the shroud, wherein at least one vane of the plurality of vanes has an internal passage extending between the center body and the enclosure;

a first fuel path leading to a plurality of first fuel outlets disposed on the plurality of vanes; and a second fuel path leading to a first plurality of second fuel outlets disposed on the hub and a second plurality of second fuel outlets disposed on the shroud, wherein the first and second fuel paths are configured to flow first and second fuels that are different from one another, the first plurality of second fuel outlets or the second plurality of second fuel outlets is disposed at an axial distance relative to a trailing edge of at least one vane of the plurality of vanes, the axial distance is approximately 0 to approximately 50 percent of an axial length of the at least one vane, and the axial distance is upstream or downstream from the trailing edge, and wherein the second fuel path extends through a portion of the center body to the first plurality of second fuel outlets disposed on the hub and extends from the center body to the enclosure via the internal passage of the at least one vane to the second plurality of second fuel outlets disposed on the shroud.

18. The system of claim 17, wherein the first plurality of second fuel outlets is disposed on the hub at a first axial position and the second plurality of second fuel outlets is disposed on the shroud at a second axial position, and the first and second axial positions are axially offset from one another.

19. The system of claim 17, the system comprising a turbine combustor or a gas turbine engine having the multi-fuel nozzle.

* * * * *